US010670365B2

(12) United States Patent
Coleman

(10) Patent No.: US 10,670,365 B2
(45) Date of Patent: Jun. 2, 2020

(54) MODULAR SUPPORTED SHOOTING REST

(71) Applicant: Cole-Tac LLC, Unity, NH (US)

(72) Inventor: Dustin Coleman, Unity, NH (US)

(73) Assignee: Cole-Tac LLC, Unity, NH (US)

( * ) Notice: Subject to any disclaimer, the term of this patent is extended or adjusted under 35 U.S.C. 154(b) by 0 days.

(21) Appl. No.: 16/568,593

(22) Filed: Sep. 12, 2019

(65) Prior Publication Data

US 2020/0103197 A1 Apr. 2, 2020

Related U.S. Application Data

(60) Provisional application No. 62/737,543, filed on Sep. 27, 2018.

(51) Int. Cl.
*F41A 23/16* (2006.01)
*F41C 27/22* (2006.01)

(52) U.S. Cl.
CPC ..... *F41A 23/16* (2013.01); *F41C 27/22* (2013.01)

(58) Field of Classification Search
CPC ..... F41C 27/22; F41C 33/001; F41A 23/16
USPC ..... 42/94; 89/37.04
See application file for complete search history.

(56) References Cited

U.S. PATENT DOCUMENTS

| | | | | |
|---|---|---|---|---|
| 5,233,779 | A | 8/1993 | Shaw | |
| 5,332,185 | A | 7/1994 | Walker, III | |
| 5,857,651 | A * | 1/1999 | Kunevicius | F41B 5/14 248/218.4 |
| 5,875,580 | A | 3/1999 | Hill et al. | |
| 8,286,381 | B2 * | 10/2012 | Seuk | F41C 27/22 42/73 |
| 8,516,733 | B1 | 8/2013 | Richey, Jr. et al. | |
| 8,813,408 | B1 * | 8/2014 | Knight, Sr. | F41C 33/001 224/149 |
| 2010/0251592 | A1 * | 10/2010 | Otto | F41C 23/18 42/94 |
| 2014/0190060 | A1 * | 7/2014 | Sherman | F41A 23/10 42/94 |
| 2015/0292830 | A1 | 10/2015 | Treadaway | |

* cited by examiner

*Primary Examiner* — Stephen Johnson
(74) *Attorney, Agent, or Firm* — Wood Herron & Evans LLP

(57) ABSTRACT

Provided is a detachable supported shooting rest having a rigid support frame and a plurality of differently sized/shaped conformable support units. The frame is removably attached to a firearm and has spaced-apart support unit attachment locations. The conformable support units are interchangeably attachable to the frame at the attachment locations without removal of the frame from the firearm.

11 Claims, 4 Drawing Sheets

MODULAR SUPPORTED SHOOTING REST

RELATED APPLICATIONS

This application claims priority to U.S. Provisional Patent Application No. 62/737,543, filed Sep. 27, 2018, and incorporates the same herein by reference.

TECHNICAL FIELD

This invention relates to shooting supports or rests for firearms. Particularly, it relates to a shooting support frame that can be attached to the forearm or barrel of a rifle and which has one or more detachable, interchangeable support or rest units.

BACKGROUND

There are a wide variety of shooting rests, bags, and pads available for supporting the forearm of a rifle (or shotgun). Many of these include deformable bags filled with displaceable material, such as sand, beans, or beads, such that it can conform to the shape of the surface on which it is resting and to the position of the forearm. In some embodiments, the amount of fill material may be varied to adjust the firmness of the conformable unit. Because the circumstances under which a shot in the field (or in competition) is to be taken may vary greatly, a shooter may need to have support bags in a variety of sizes and shapes.

Typically, a sand bag type rest is used elevate and/or position the barrel or forearm of the firearm and the bag is kept in position simply by gravity or by pressure applied against it by the shooter. Other rests may include some device for holding it in place, such as a magnet, clamp, or friction material. In some cases, a conformable shooting support may be attachable to the rifle forearm or barrel. However, the available products do not allow interchangeability of size and/or shape of the rest, other than to exchange the entire device for a different one, and a long or large bag attached to the forearm at one point may sag or droop when lifted.

SUMMARY

The present invention provides a frame attachable to the forearm and to which multiple conformable rest bags or units can be attached or removed to allow variations is size, shape, and/or material, without having to remove the frame from the forearm.

One embodiment provides a detachable supported shooting rest having a rigid support frame and a plurality of differently sized/shaped conformable support units. The frame is removably attached to a firearm and has spaced-apart support unit attachment locations. The conformable support units are interchangeably attachable to the frame at the attachment locations without removal of the frame from the firearm.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
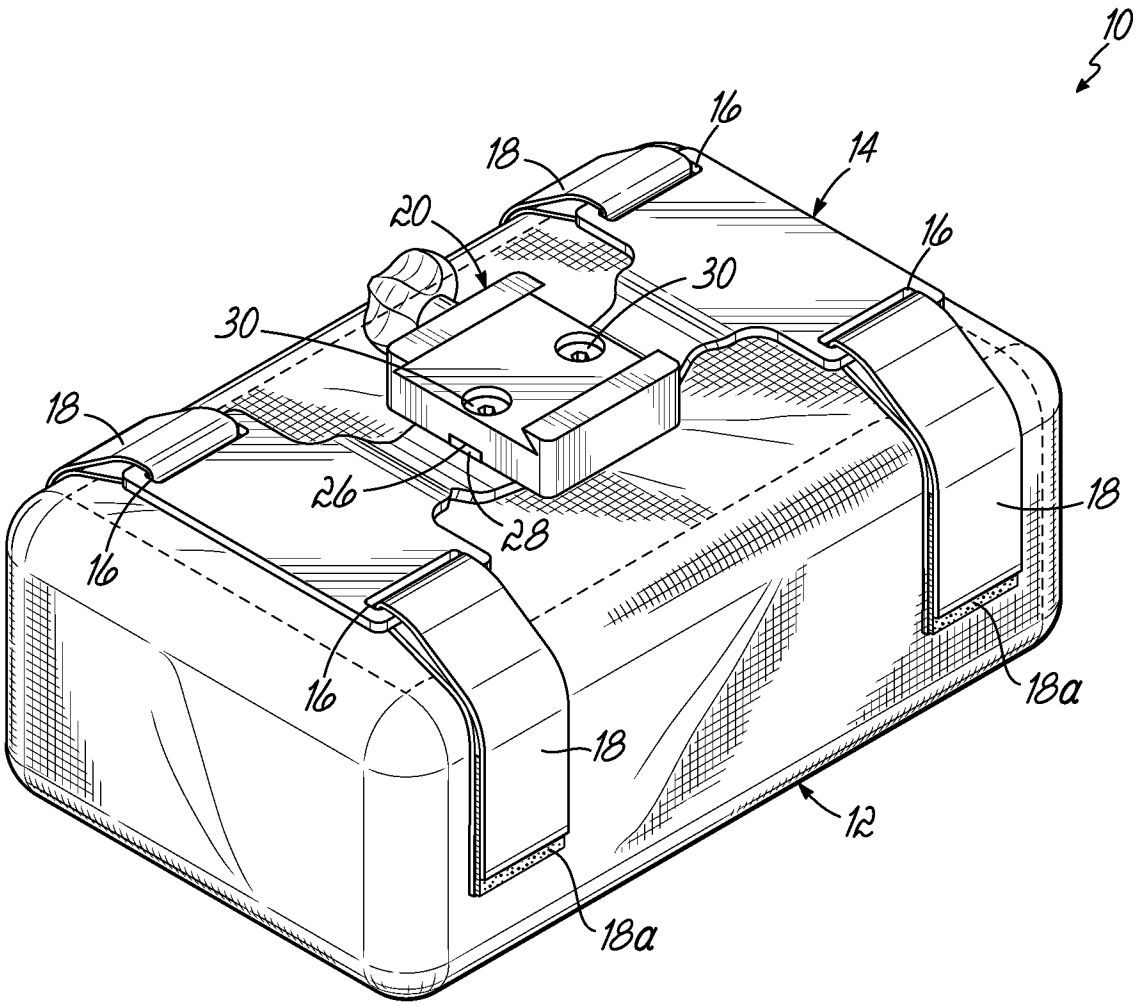
FIG. 1 is an isometric view of a detachable supported shooting rest according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner. As used herein, "firearm" is intended to include a rifle, shotgun, handgun, muzzle-loading arm, air gun, or any other shooting device.

Figure 2:
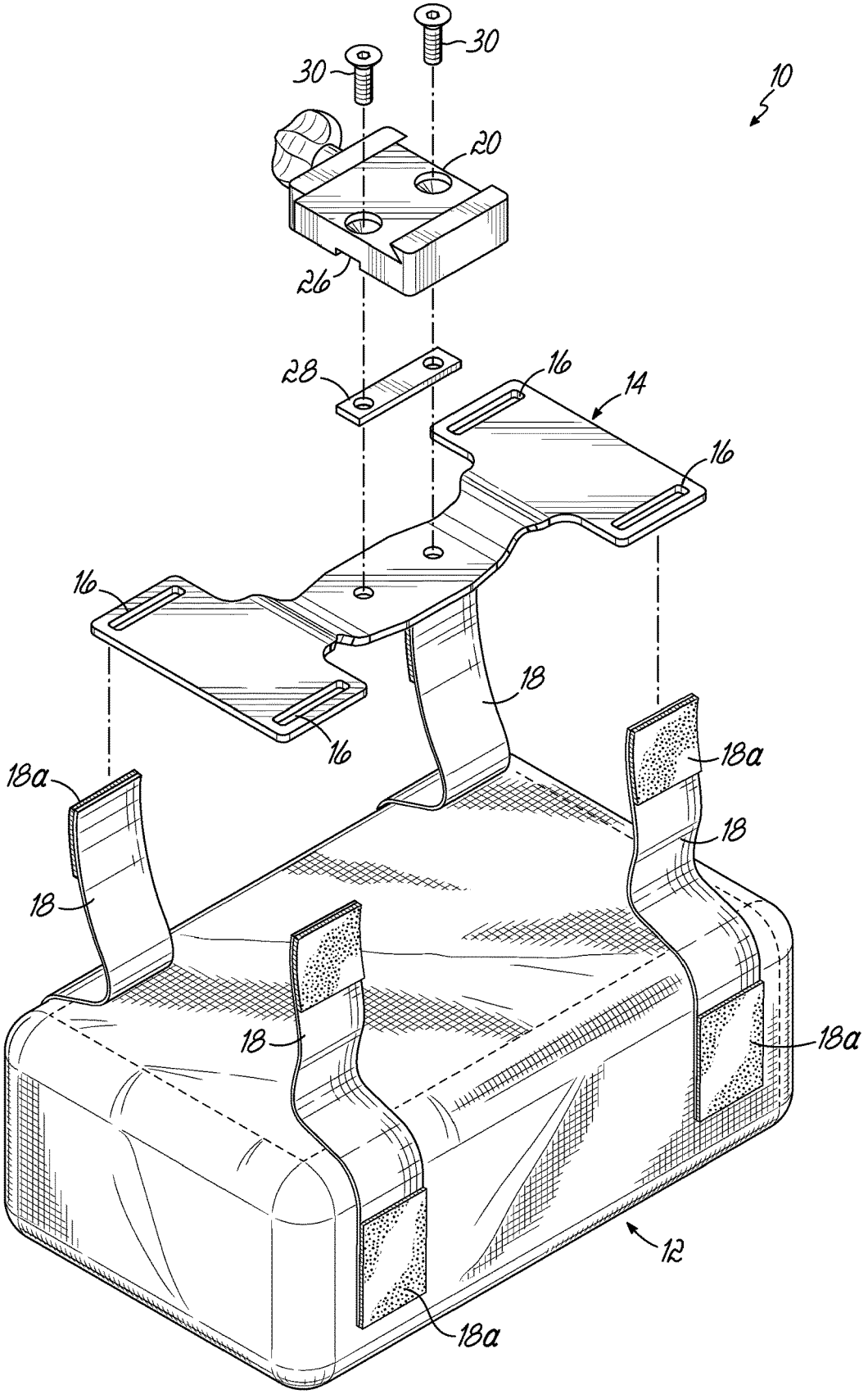
FIG. 2 is an isometric exploded view thereof.

Referring to the various drawing figures, and first to FIGS. 1 and 2, therein is shown a support device 10 according to one embodiment of the present invention. The device 10 includes a conformable rest unit 12, such as in the form of a fabric bag that may be substantially filled with conformable fill material. The conformable fill material may be a flowable granular solid, such as sand, beans, seeds, or pellets. Alternatively, the fill may be an open or closed cell foam material or an encapsulated gel. The bag may be made of canvas, synthetic woven "ballistic" fabric, leather, and/or other flexible materials that provide a selected degree of flexibility, durability, and surface friction. It is to be understood that the rest unit 12 illustrated is but one example, and a wide variety of other rest units (some examples shown in FIG. 3) of varied size, shape, or material are intended to be readily interchangeable therewith.

The invention includes a support beam or frame 14 that may include two or more spaced-apart attachment features or means. In the illustrated embodiments, the support frame 14 is elongated and includes a pair of laterally spaced apart attachment slots 16 at each of the opposite ends of the frame 14. The rest unit 12 includes complementary attachment members, in this case fastenable straps 18 that are positioned and oriented to allow ready attachment of the rest unit 12 to the attachment slots 16 of the support frame 14 to stay securely attached, but to allow detachment therefrom at will. In the embodiment illustrated in FIGS. 1-3, the straps 18 can be made of or include hook-and-loop fastening surfaces 18*a* to allow position-adjustable attachment. Other forms of fasteners may be used, including snaps, buttons, or hooks of any suitable type. The attachment feature or means may include one side of hook-and-loop fastening material secured to selected, spaced-apart positions on the frame 14 (such as by adhesive) and the mating material fixed to an area or areas of the rest unit 12. Any other type of device that allows detachable attachment of different rest units 12 to the frame 14 may be used as the attachment means.

The support frame 14 may be formed of sturdy, light-weight material, such as metal or a relatively rigid polymer/plastic (such as Kydex®) or composite material (such as carbon fiber in epoxy resin). According to one embodiment, the frame 14 may be designed to impart longitudinal rigidity to the rest unit 12 when it is attached. The length, width, and shape of the frame 14 may be selected to provide other benefits or features. For example, it may be shaped to position the rest unit 12 close to or spaced from the firearm, or it may be shaped to control the degree or extent of deformation of the rest unit 12. The frame 14 also keeps the rest unit 12 in position and from rolling relative to the firearm. A single point connection or flexible attachment can allow the rest bag to sag, droop, or fold in undesired ways. Bags that attach directly to or around a rifle barrel or forearm with fabric or straps can expose these materials to potentially damaging hot surfaces.

Figure 3:
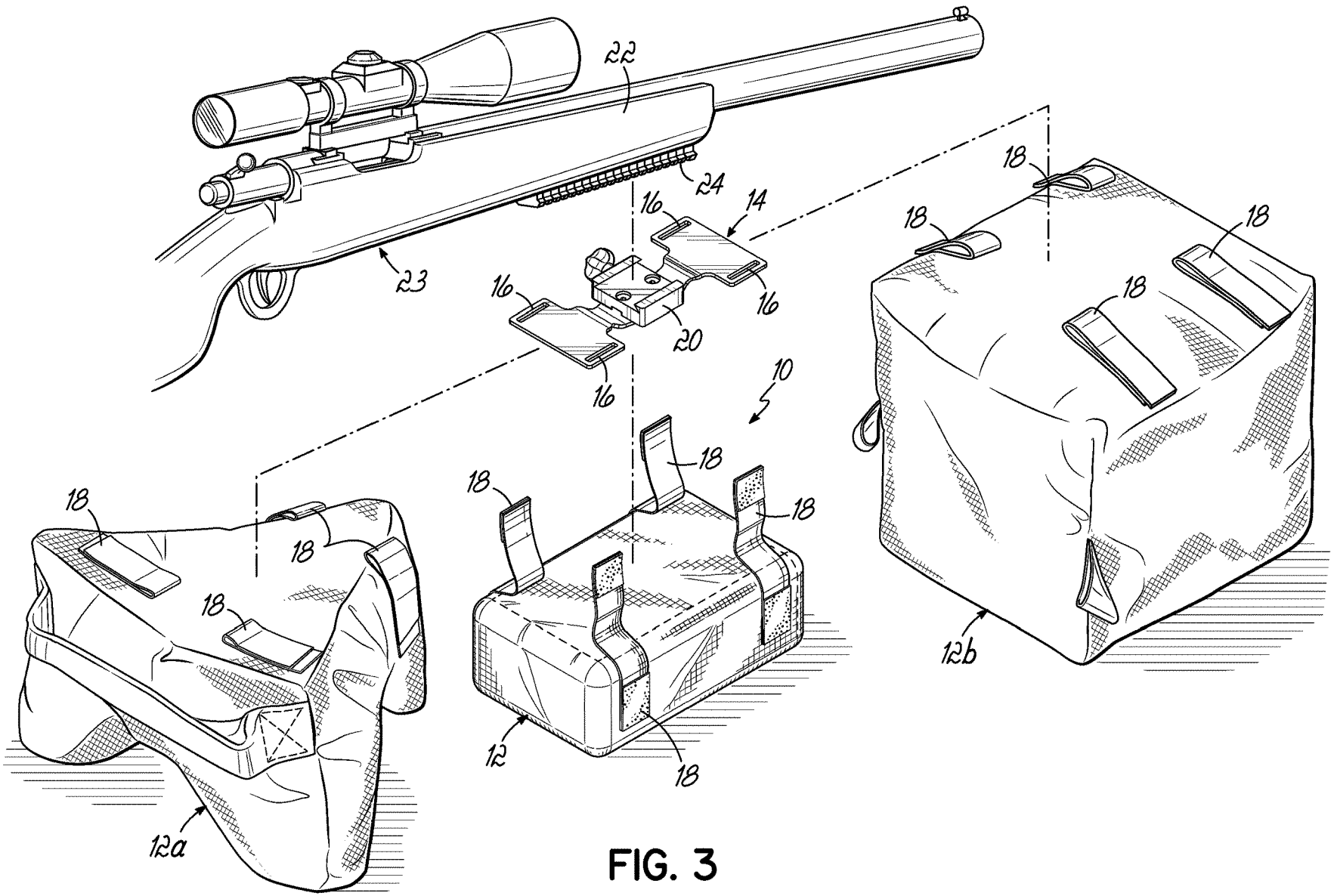
FIG. 3 is a pictorial exploded view showing the forearm of a firearm, a support frame attachable to the firearm, and multiple conformable rest bags that are detachably attachable to the frame.

As depicted in FIG. 3, the support frame 14 may be detachably fixed to the forearm 22 or other part of a rifle 23. For example, a standard accessory rail 24 (such as a 1913 MIL-STD or "Picatinny" or an ARCA™ rail (made by Area 419 Firearms, LLC of Toledo, Ohio)) may be used in conjunction with a securement means. The securement means may be a removable mounting attachment 20. The attachment 20 may clamp with a threaded fastener or a quick-throw lever, for example. The exact nature of the attachment of the frame 14 to the forearm 22 or other part of the rifle 23 is not critical to the present invention and may be any of a wide variety of standard and well-known rail mounting devices. Other types of single- or multi-point attachment devices may be used to connect the frame 14 to the forearm 22 or other part of a firearm, if desired.

Some available mounts include an orientation channel 26 that can engage a rib (not shown) on the frame or filled with an otherwise inert spacer 28. The mount or securement means 20 can be secured to the frame in any suitable manner, such as with threaded fasteners 30. If desired, the securement means 20 could include a rotating or pivot function (not shown), such as along a substantially vertical axis of rotation, or a tilting function (not shown) that would allow the frame 14 to be rotated and/or tilted relative to the longitudinal direction of the forearm 22 to which it is attached.

As depicted in FIG. 3, according to one aspect of the present invention, a support frame 14 is attachable to the forearm 22 or barrel of a firearm, such as a rifle 23. A plurality of different rest units 12, 12*a*, 12*b* may then be securely but easily attached to and removed from the support frame 14, allowing the shooter to select from a variety of sizes and shapes without having to remove the support frame 14 from the firearm, without having a separate support frame 14 for each rest unit 12, 12*a*, 12*b*, and/or without having a support frame or stiffening member integral with the rest unit 12, 12*a*, 12*b*. It also allows rest units 12, 12*a*, 12*b* to be used separate from the frame 14 as ordinary "sand bag" type rests. Incorporating a fixed stiffening frame into a shooting rest bag adds cost and weight to the bags and makes them less versatile for unattached use.

Examples of alternate rest units 12, 12*a*, 12*b*, not meant to be limiting in any way, are shown in FIG. 3. By using one support frame 14 with multiple rest units 12, 12*a*, 12*b*, the cost and weight of each rest unit 12, 12*a*, 12*b* is minimized while allowing them to be easily interchanged and allowing each of them to benefit from the rigidity of the support frame 14.

Figure 5:
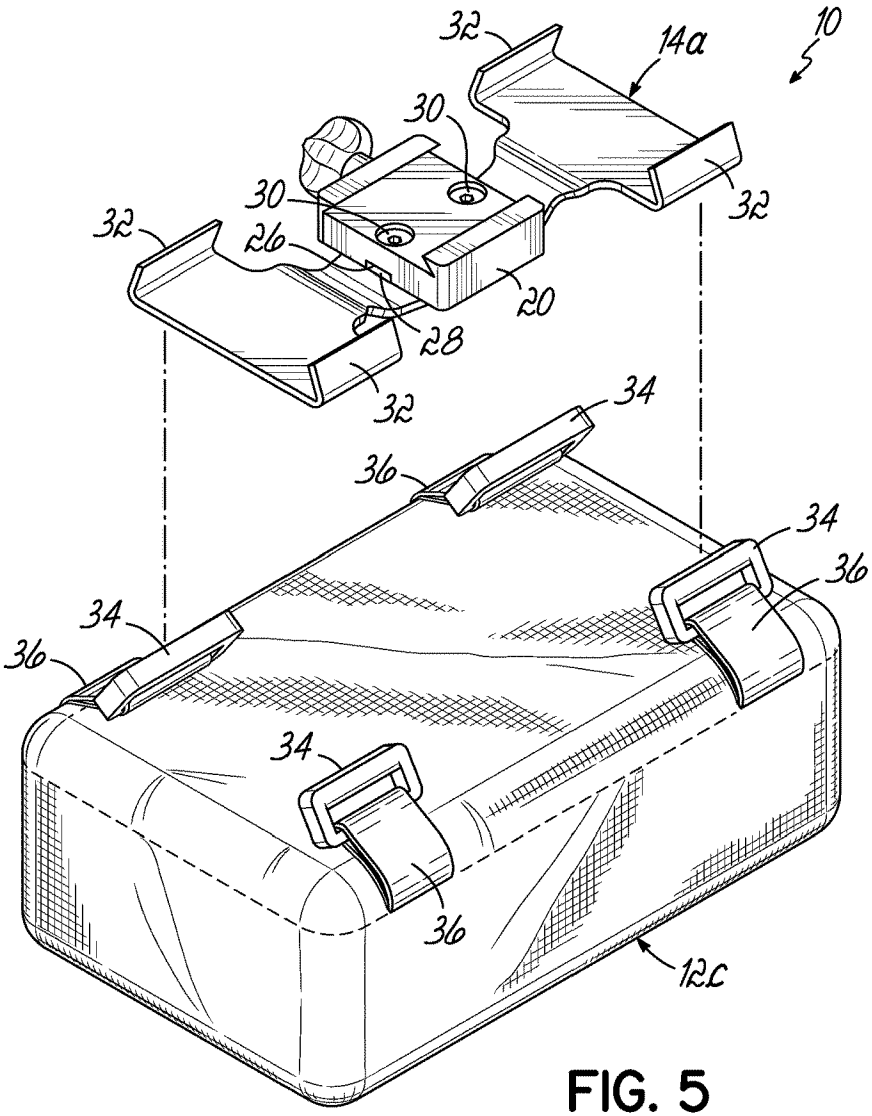
FIG. 5 is an exploded isometric view thereof showing detachment of the conformable rest bag.
Figure 4:
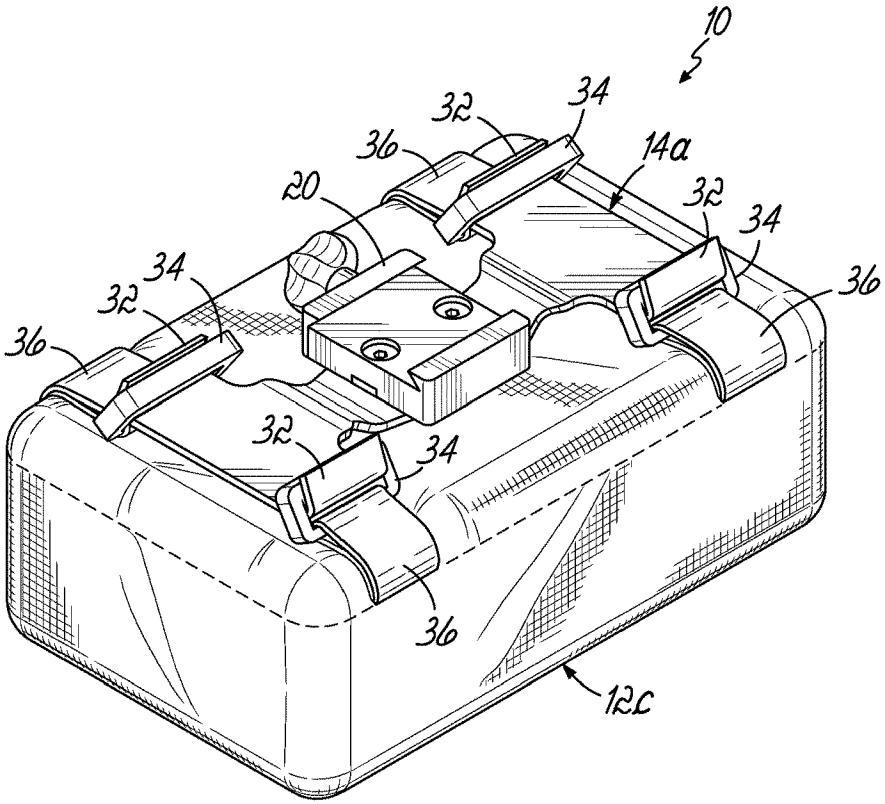
FIG. 4 is an isometric view of a second embodiment.

As shown in FIGS. 4 and 5, the bag attachment means of the support frame 14*a* can be upwardly turned tabs or hooks 32 and the attachment members of the rest unit 12 may be square rings 34 that are secured to the rest unit 12*c* such as with fabric webbing material 36 and/or by sewing.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A detachable supported shooting rest, comprising:

a rigid support frame having means for removably securing the frame to a firearm so that the frame is situated below the firearm; and a conformable support unit detachably attachable to the frame at spaced-apart attachment locations on the frame without removal of the frame from the firearm, the conformable support unit including a flexible enclosure with conformable fill material.

2. The device of claim 1, wherein the frame includes openings and the support unit includes attachment straps, each of the straps configured to extend through a slot to removably attach the support unit to the frame.

3. The device of claim 2, wherein the straps are configured to provide adjustable attachment.

4. The device of claim 2, wherein the straps include hook-and-loop fasteners.

5. The device of claim 1, wherein the frame is elongated and includes support unit attachment locations positioned adjacent opposite longitudinal ends of the frame.

6. The device of claim 5, wherein the frame includes a plurality of laterally spaced-apart attachment locations adjacent each longitudinal end.

7. The device of claim 5, wherein the securing means is located generally midway between opposite ends and the frame is configured to position the support unit attachment locations close to the firearm.

8. The device of claim 1, wherein the frame includes hooks and the support unit includes attachment rings, each of the attachment rings configured to be engageable on a hook to removably attach the support unit to the frame.

9. A detachable supported shooting rest, comprising:

a rigid support frame having means for attaching the frame to a firearm, the frame having spaced-apart support unit attachment locations;

a first conformable support unit having a first size and shape;

a second conformable support unit having a size or shape different from that of the first conformable pad;

each of the first and second conformable support units including a flexible enclosure with conformable fill material; and means for interchangeably attaching the first and second conformable unit to the frame at the attachment locations without removal of the frame from the firearm.

10. The device of claim 1, wherein the flexible enclosure includes a fabric bag and the flowable fill material includes a granular solid.

11. The device of claim 9, wherein each of the first and second flexible enclosures includes a fabric bag and the flowable fill material includes a granular solid.

* * * * *